US005322811A

United States Patent [19]

Komuro et al.

[11] Patent Number: 5,322,811

[45] Date of Patent: Jun. 21, 1994

[54] METHOD FOR MANUFACTURING A RECORDING HEAD WITH INTEGRALLY HOUSED SEMICONDUCTOR FUNCTIONAL ELEMENTS

[75] Inventors: Hirokazu Komuro, Yokohama; Takayoshi Tsutsumi, Tokyo, both of Japan

[73] Assignee: Canon Kabushiki Kaisha, Tokyo, Japan

[21] Appl. No.: 922,398

[22] Filed: Jul. 31, 1992

[30] Foreign Application Priority Data

Aug. 1, 1991 [JP] Japan ..... 3-193190

[51] Int. Cl.[5] ..... H01L 21/70

[52] U.S. Cl. ..... 437/51; 437/2; 437/3; 437/4; 437/59

[58] Field of Search ..... 437/2, 3, 4, 209, 51, 437/52, 53, 54, 59, 60

[56] References Cited

U.S. PATENT DOCUMENTS

| | | | |
|---|---|---|---|
| 4,429,321 | 1/1984 | Matsumoto | 346/140 R |
| 4,466,181 | 8/1984 | Takishima | 437/209 |
| 4,559,543 | 12/1985 | Toganoh et al. | 346/140 R |
| 4,612,408 | 9/1986 | Moddel et al. | 437/2 |
| 4,660,277 | 4/1987 | Tei | 437/3 |
| 4,860,033 | 8/1989 | Shiozaki et al. | 346/140 R |
| 4,999,077 | 3/1991 | Drake et al. | 437/209 |
| 5,013,670 | 5/1991 | Arikawa et al. | 437/2 |
| 5,059,543 | 10/1991 | Wise et al. | 437/3 |
| 5,064,771 | 11/1991 | Solomon | 437/3 |
| 5,156,998 | 10/1992 | Chi et al. | 437/209 |

*Primary Examiner*—Brian E. Hearn
*Assistant Examiner*—Kevin M. Picardat
*Attorney, Agent, or Firm*—Fitzpatrick, Cella, Harper & Scinto

[57] ABSTRACT

A method for manufacturing a recording head with integrally housed functional elements includes the steps of:

(a) providing a plurality of base members each having a single-crystal semiconductor layer thereon, (b) bonding the single-crystal semiconductor layers of the plurality of base members to the surface of a common substrate in a face-to-face state, (c) removing the plurality of base members such that the single-crystal semiconductor layers remain on the common substrate, and (d) forming semiconductor functional elements on the common substrate while forming an electrothermal transducer serving to generate thermal energy on the common substrate using the single-crystal semiconductor layers.

7 Claims, 17 Drawing Sheets

METHOD FOR MANUFACTURING A RECORDING HEAD WITH INTEGRALLY HOUSED SEMICONDUCTOR FUNCTIONAL ELEMENTS

BACKGROUND OF THE INVENTION

1. Field of the Invention

The present invention relates to a method for manufacturing a thermal head or an ink jet recording head. More particularly, the invention relates to a method for manufacturing a lengthy recording head with integrally housed semiconductor functional elements comprising diodes, transistors, or the like.

2. Related Background Art

There is known an ink jet recording head provided with a transistor integrally housed therein as disclosed in U.S. Pat. No. 4,429,321.

This ink jet recording head is of the constitution shown in FIG. 16. FIG. 16 is a schematic cross section view illustrating the constitution of the ink jet recording head.

In FIG. 16, numeral reference 801 stands for the entire element bearing member provided with transistors 810. On the element bearing member 801, there is disposed a top plate member 829 capable of serving to form an ink discharging outlet 823, a liquid pathway 822 and a common liquid chamber 824. Numeral reference 808 stands for an ink feed pipe connected to the common liquid chamber 824.

The element bearing member 801 comprises a p-type semiconductor region 815 and an $n^-$-type semiconductor region 819 disposed on the p-type semiconductor region 815. Numeral reference 830 stands for an isolation region which serves to isolate the $n^-$-type semiconductor region 819 from the constituent $n^-$-type semiconductor region 825 as a highly resistive layer of the transistor 810. The isolation region 830 is comprised of a potion extending from the p-type semiconductor region 815.

The transistor 810 comprises a collector region comprising said highly resistive layer 825, an $n^+$-type semiconductor layer region 828-2, an embedded layer region 828-1, a p-type base region 826, and an $n^+$-type emitter region 827.

On the surface side of the element bearing member 801, there are provided a heat accumulating layer 818, a heat generating resistive layer 820, a common electrode 809, an individual electrode 811, a base electrode 813, an emitter electrode 814, an insulating layer 817, and a protective layer 821. Numeral reference 805 stands for an electrothermal transducer provided with a heat generating portion 812.

In the recording head shown in FIG. 16, when a signal is inputted into the base electrode 813 of the transistor 810, the transistor is turned on to allow an electric current to flow in the heat generating resistive layer 820. Thus, heat is transferred to ink in the liquid pathway 822 through the heat generating portion 812 to create at least a bubble due to evaporation of the ink, wherein ink is discharged through the ink discharging outlet 823 by the pressure of the bubble created.

The recording head shown in FIG. 16 is fabricated in the following manner. That is, the embedded layer region 828-1 is firstly formed on a p-type single-crystal member capable of serving as the p-type semiconductor region 815 by means of a conventional ion implantation technique, followed by forming an $n^-$-type epitaxial layer by way of epitaxial growth. The isolation region 830 is then formed by incorporating a p-type impurity into the corresponding portion of the $n^-$-type epitaxial layer by means of vapor-phase diffusion technique, whereby (a) an $n^-$-type epitaxial layer region to be the $n^-$-type semiconductor region 819 and (b) another $n^-$-type epitaxial layer region to be the highly resistive layer 825, which are isolated by the isolation region 830 one from another, are established. The base region 826 is formed by implanting boron ions into the corresponding portion of the $n^-$-type epitaxial layer region (b) by means of ion implantation technique. The emitter region 827 is formed by implanting phosphorous ions into the corresponding portion of the base region 826 formed in the above by means of ion implantation technique. The $n^+$-type semiconductor layer region 828-2 which serves as the collector is formed by implanting phosphorous ions into the corresponding portion of the $n^-$-type epxitaxial layer region (b) by ion implantation technique.

Subsequently, a silicon oxide layer as the heat accumulating layer 818 is formed by means of thermal oxidation technique. A hafnium boride layer as the heat generating resistance layer 820 is then formed by means of a sputtering technique. Thereafter, electrodes 809, 811, 813 and 814 respectively comprised of aluminum are formed respectively by means of a sputtering technique.

The recording head shown in FIG. 16 is fabricated by fixing the top plate member 829 to the element bearing member 801 obtained in the above as illustrated in FIG. 16.

Now, there is an increased demand for reduction in the production cost as for a recording head of this kind. Particularly, as for the active element used in the circuit which drives the electrothermal transducer serving as the heater for discharging ink, the production cost becomes unavoidably high in the case where an integrated circuit (IC) is externally disposed. In order to attain the reduction in the production cost, it is desirable to integrate such element with the element bearing member in which the electrothermal transducer is to be formed as in the case of the recording head shown in FIG. 16.

However, in order to accomplish such integration as desired without reduction in the characteristics required, it is necessary to use a high quality semiconductor.

As long as a small-sized recording head which can be fabricated using a single-crystal silicon wafer is concerned, it is possible to provide at a relatively low production cost such small-sized recording head capable of displaying a sufficient performance even if it is of the constitution shown in FIG. 16.

The constitution shown in FIG. 16 is, however, almost impossible to be applied in the fabrication of a lengthy recording head having a wide ink discharging outlet surface equivalent to the width of a large-sized recording medium, for example, of A-4 size. This is due to the fact that a commercially available single-crystal silicon wafer is a disc of 6 to 8 inches in diameter and because of this, it is impossible to attain the fabrication of such lengthy recording head as above mentioned using such small-sized single-crystal silicon wafer.

In view of the above situation, the conventional lengthy recording head is structured as shown in FIG. 17. The recording head shown in FIG. 17 comprises a head 852 comprising a thin film resistor formed on a glass substrate which serves as the heat generating portion and a plurality of external functional elements (switching transistors in other words) 850 respectively comprising an IC, wherein the head 852 and the plurality of functional elements 850 are disposed on a common supporting member 854 made of Al for example, and each of the plurality of functional elements 850 is electrically connected to the head 852 by means of a wire 853 for example.

There is also a problem as for the lengthy recording head of the constitution shown in FIG. 17 that the production cost becomes unavoidably high since numerous expensive ICs are used.

In addition, as the thin film semiconductor element in the prior art, there is no choice but to use a limited base member such as a member comprising a so-called SOS (silicon-on-sapphire) or a member comprising a so-called SIMOX which has an insulating region comprising silicon oxide in a semiconductor wafer, and because of this, it is almost impossible to provide a recording head at a reduced production cost.

Thus, there is an increased demand for provision of an appropriate method which makes it possible to efficiently fabricate not only a desirable lengthy recording head but also an improved recording head having highly functional semiconductor elements integrally housed therein at a reduced production cost.

SUMMARY OF THE INVENTION

The principal object of the present invention is to eliminate the foregoing problems in the prior art and to satisfy the foregoing demand.

Another object of the present invention is to provide an improved lengthy recording head having highly functional semiconductor elements integrally housed therein.

A further object of the present invention is to provide a method which makes it possible to efficiently manufacture an improved lengthy recording head having highly functional semiconductor elements integrally housed therein.

A still further object of the present invention is to provide a method which enables one to provide an improved lengthy recording head having highly functional semiconductor elements integrally housed therein at a reduced production cost.

The feature of the method for manufacturing a recording head having highly functional elements integrally housed therein according to the present invention comprises: providing a plurality of base members respectively having a single-crystal semiconductor layer thereon; bonding said single-crystal semiconductor layers formed on said plurality of base members to the surface of a common substrate in a face-to-face state; removing said plurality of base members such that said single-crystal semiconductor layers remain on said common substrate; and forming semiconductor functional elements on said common substrate while forming an electrothermal transducer serving to generate thermal energy on said common substrate using said single-crystal semiconductor layers.

In the following, the feature of the method for manufacturing a recording head having highly functional elements integrally housed therein according to the present invention will be described with reference to FIG. 1(*a*) through FIG. 1(*f*).

Shown in FIG. 1(*a*) through FIG. 1(*f*) is the case where a single base member having a single-crystal semiconductor layer thereon is used for simplification purpose.

Firstly, as shown in FIG. 1(*a*), there is provide a base member 901 (provisional substrate in other words) having a semiconductor layer 902 thereon. The semiconductor layer 902 may be a semiconductor layer grown the surface of a single-crystal semiconductor member as the base member 901 by way of epitaxial growth. In an alternative, metal ions capable of causing an insulating material are implanted into a single-crystal semiconductor member as the base member 901 by an ion implantation technique to form a stacked structure comprising semiconductor layer/insulating layer/semiconductor member, and the semiconductor layer of the resultant may be used as the semiconductor layer 902.

Separately, there is provided a substrate 903 (see, FIG. 1(*b*).

Then, as shown in FIG. 1(*c*), the surface of the semiconductor layer 902 on the base member 901 is bonded to the surface of the substrate 903 in a face-to-face state. In this case where these surfaces are mirror finished, they can be affixed together by the van der Waals force without using any adhesive or the like.

Subsequently as shown in FIG. 1(*d*), the base member 901 is removed such that the semiconductor layer 902 remains on the substrate 903. Numeral reference 100 stands for a composite comprising the substrate 903 and the semiconductor layer 903. The composite will be hereinafter called "element bearing member".

The removal of the base member 901 in this case can be easily performed by means of either a conventional selective polishing technique or a conventional selective etching technique.

In the semiconductor layer 902 of the element bearing member 100 thus obtained, a semiconductor functional element FE is formed. In the case shown in FIG. 1(*e*), the semiconductor functional element FE is a thin film diode including an anode region 904 and a cathode region 905 as an example.

Thereafter, an insulating layer 906 is formed on the semiconductor layer 902, followed by forming an electrothermal transducer ET thereon.

In FIG. 1(*f*), the electrothermal transducer ET comprises a heat generating resistive layer 907, a common electrode 908, and an individual electrode 909, on which a protective layer 911 is disposed. Numeral reference 910 in FIG. 1(*f*) stands for a cathode electrode.

In this way, there can be obtained a recording head of the constitution shown in FIG. 1(*f*) which is provided with semiconductor functional elements integrally housed therein which serve to generate thermal energy.

When this recording head is used as a thermal head, the constitution shown in FIG. 1(*f*) is the ultimate.

But in the case where the recording head is intended to be used as an ink jet recording head, it is required to dispose a top plate member on the side of the surface of the element bearing member 100 in order to form a plurality of ink discharging outlets.

FIG. 2 is a schematic perspective view illustrating the configuration of an example of such ink jet recording head comprising the foregoing element bearing member 100 and a top plate member disposed thereon. In FIG. 2, numeral reference 200 stands for the entire of the ink jet recording head comprising the foregoing element bearing member 100 shown in FIG. 1(*f*) and a top plate member 200 disposed thereon. The ink jet recording head is provided with a plurality of ink discharging outlets 223 and an ink feed pipe 208. Upon performing recording, ink is supplied into the liquid chamber (not shown) installed in the inside of the ink jet recording head. It is desirable to seal the ink discharging outlets 223 with an appropriate sealing member when recording is not conducted.

As above described, according to the present invention, it is possible to obtain a semiconductor-bearing member with an optional size and an optional configuration by transferring a plurality of high quality semiconductor layers respectively situated on an independent base member (provisional substrate in other words) onto a substrate made of an optional material. In addition to this, there can be easily obtained a desirable SOI substrate (which has a thin semiconductor film on an insulating surface). Because of this, it is possible to provide a high-performance recording head at a reduced production cost.

Further, according to the present invention, after the semiconductor functional element having been formed in each of the high quality semiconductor layers, it is possible to form an electrothermal transducer at a desired boundary portion of each of the semiconductor layers, and because of this, the precision of the semiconductor functional element to be formed and the precision of the electrothermal transducer to be formed can be independently controlled one from the other as desired.

As the base member (provisional substrate) 901 used in the present invention, there is a member on which a high quality semiconductor layer can be formed. Specific examples of such member are single-crystal semiconductor members and porous semiconductor members.

As the substrate 903, there can be used any of the known substrates capable of being used as a substrate of a recording head. The substrate 903 may be either electroconductive or insulating. Specifically, the substrate 903 be a member composed of glass, ceramics, quartz, aluminium, stainless steel, resin, or the like. In the case where the substrate 903 is composed of an electroconductive material, it is desired to dispose an insulating film on the surface thereof.

The semiconductor layer 902 in which the semiconductor functional element is to be formed can include tetrahedral semiconductors of silicon, germanium, etc. and compound semiconductors such as gallium arsenide, indium arsenide, gallium aluminum arsenide, etc.

The insulating layer 906 may be composed of an insulating material such as silicon oxide, silicon nitride, etc.

The heat generating resistive layer 907 may be composed of a metal such as titanium, nickel, chromium, zirconium, hafnium, tantalum, aluminum, etc., an alloy of these metals such as Ni—Cr, Ta—Al, etc., or a material selected from the group consisting of carbides, borides and nitrides of a metal such as titanium, nickel, chromium, zirconium, hafnium, tantalum, aluminum, etc.

The protective layer 911 may be composed of silicon oxide, silicon nitride, an inorganic material such as PSG film, BSG film or BPSG film obtained by doping silicon oxide with P or/and B, or an organic material such as polyimide, epoxy resin, silicone resin, etc.

The semiconductor functional element formed by using the foregoing semiconductor layer 902 can include diodes, bipolar transistors, insulated gate transistors, electrostatic induction transistors, thyristers, and the like.

In the present invention, the semiconductor functional element may be used as a simple switching element or a rectifying element. In an alternative, the semiconductor functional element may be formed so as to establish an integrated circuit in the semiconductor layer. The circuit which can be employed in this case can include digital or analog circuits such as shift register, memory, A/D converter, D/A converter, OR circuit, AND circuit, and amplifier.

DETAILED DESCRIPTION OF THE INVENTION AND THE PREFERRED EMBODIMENTS

The present invention will be detailed with reference to preferred embodiments which are not intended to restrict the scope of the invention. These embodiments may be properly modified as long as the object of the present invention can be attained.

Explanation will be made of the constitution of an ink jet recording head to be provided according to the present invention.

Figure 1A:
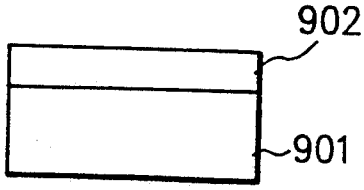
FIG. 1(*a*) through FIG. 1(*f*) are schematic views for explaining the feature of the method for manufacturing a recording head according to the present invention.
Figure 1B:
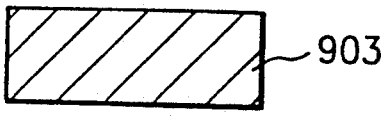
Figure 1C:
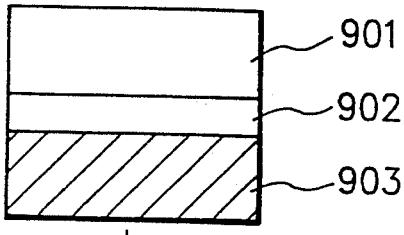
Figure 1D:
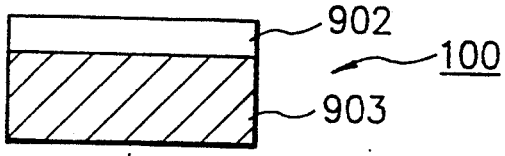
Figure 1E:
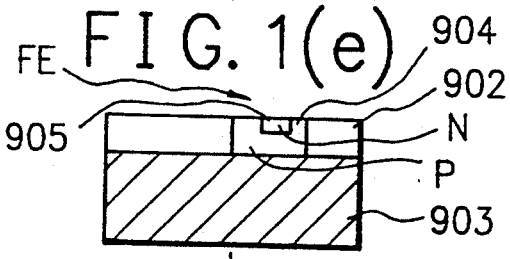
Figure 1F:
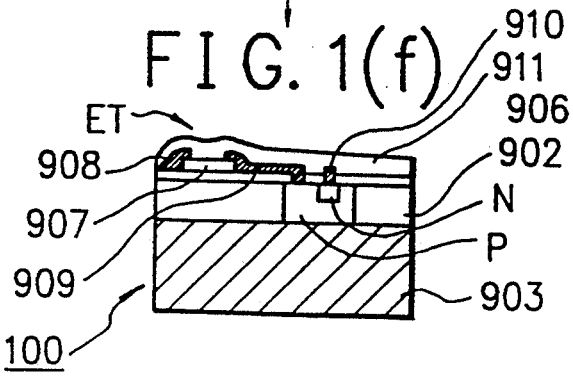
Figure 2:
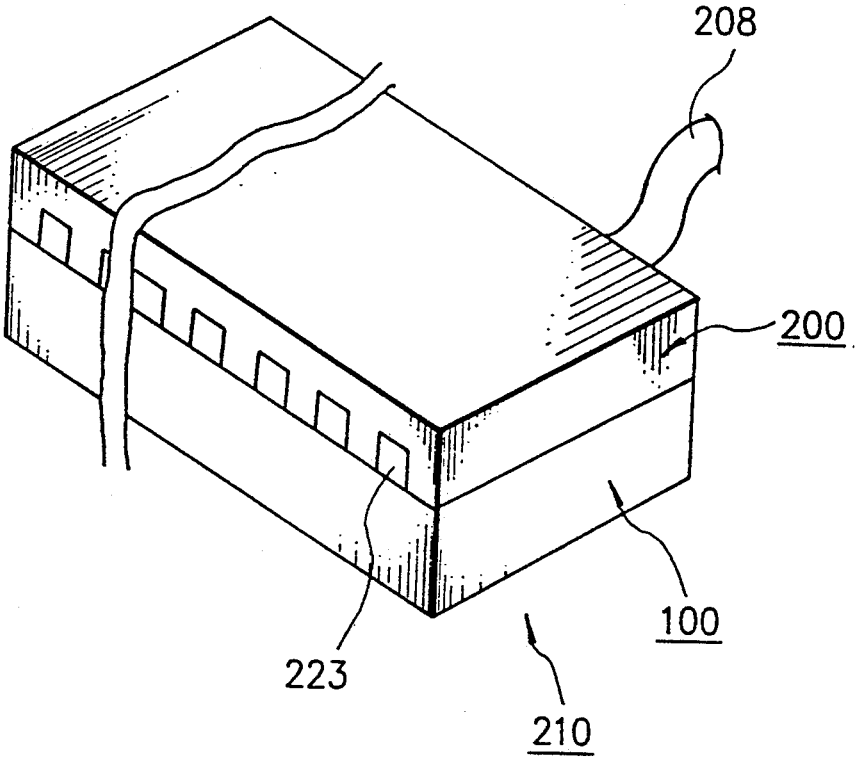
FIG. 2 is a schematic perspective view illustrating the constitution of an ink jet recording head to be provided according to the present invention.

The constitution of the ink jet recording head is the same that of the ink jet recording head shown in FIG. 2.

Particularly, the ink jet recording head 210 is a lengthy one having a ink discharging face of a length equivalent to the width of a A4 size recording medium. The number of the ink discharging outlets 223 mounted at the ink discharging face is 1728 for example. In FIG. 2, numeral reference 100 stands for an element bearing member provided with an electrothermal transducer and a semiconductor functional element. Numeral reference 200 stands for a top plate member in which cavities are arranged for forming ink pathways and a common liquid chamber (not shown in the figure). Ink discharging by this ink jet recording head upon recording is performed by applying thermal energy to ink supplied through the ink feed pipe 208 to create a bubble due to evaporation of the ink, wherein ink is discharged through the ink discharging outlets 223 by the pressure of the bubble created.

Figure 3:
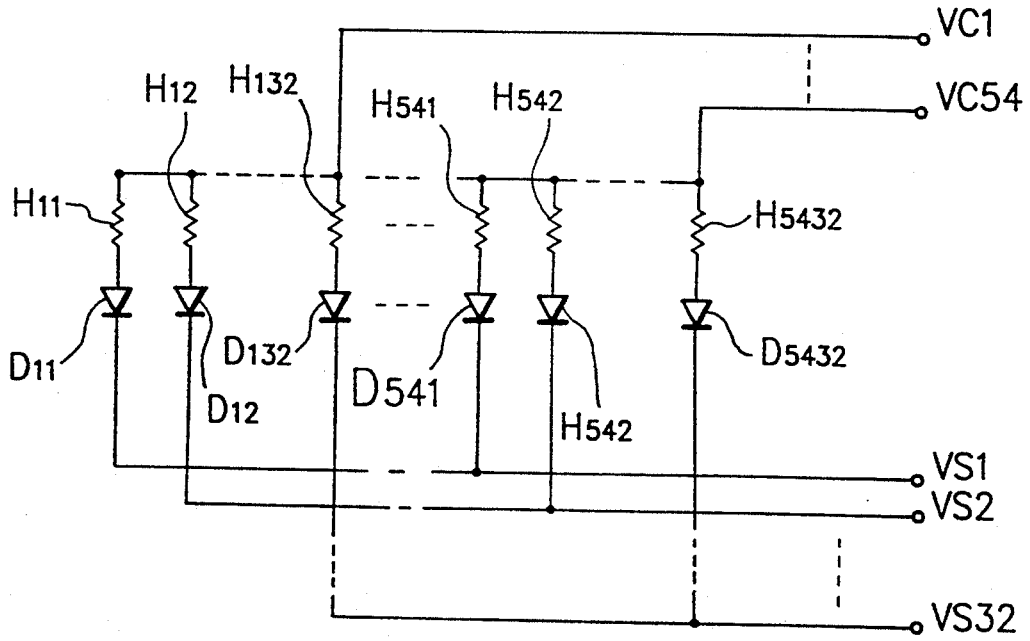
FIG. 3 is a schematic diagram of a circuit employed in a recording head to be provided according to the present invention.

The ink jet recording head shown in FIG. 2 is provided with a circuit shown in FIG. 3.

In the circuit shown in FIG. 3, there are shown only six heat generating elements $H_{11}$ to $H_{5432}$ as the electrothermal transducers and only six diodes $D_{11}$ to $D_{5432}$ as the semiconductor functional elements for simplification purpose. In practice, however, 32 segments×54 blocks totaling 1,728 heat generating elements H and diodes D are provided.

Figure 4:
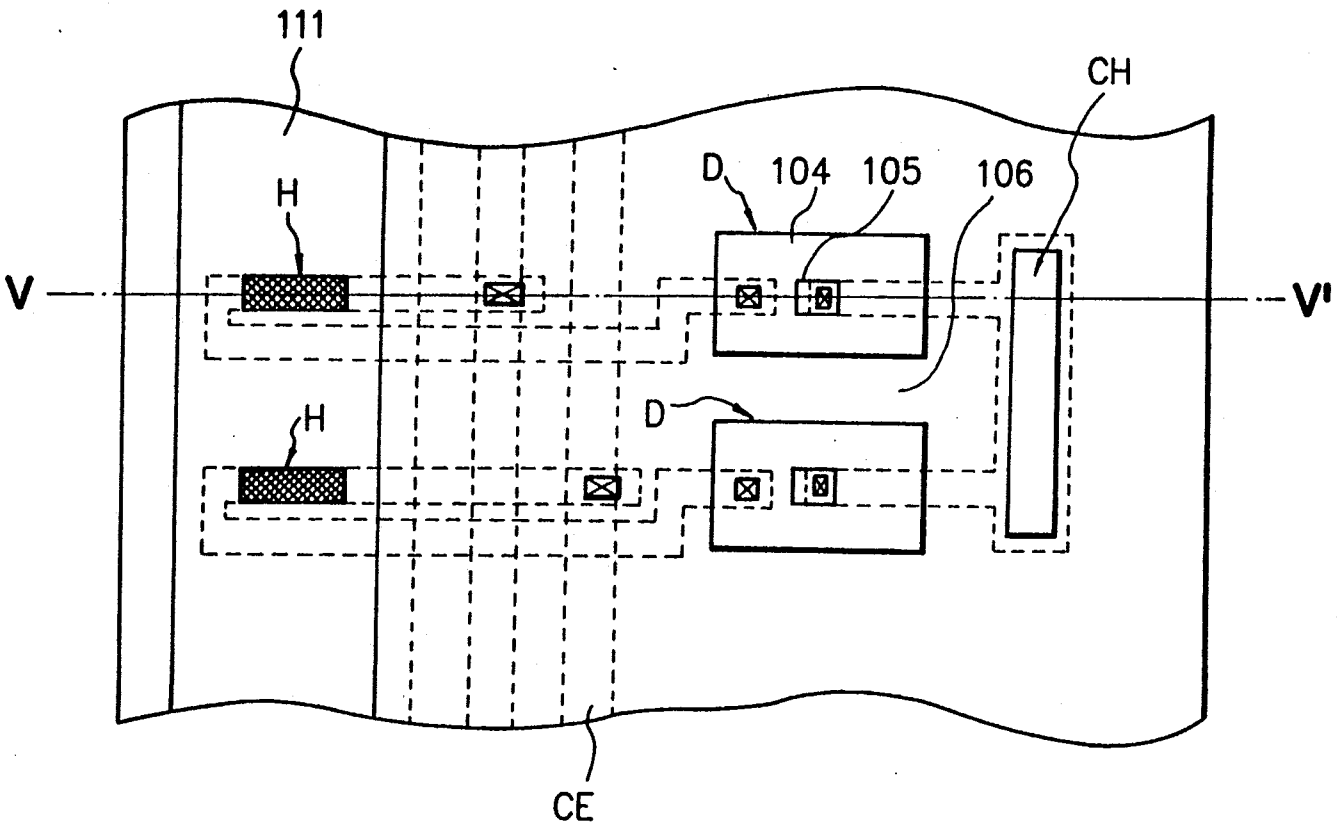
FIG. 4 is a schematic plan view illustrating the constitution of an embodiment of the recording head to be provided according to the present invention.

FIG. 4 is a schematic plan view of the element bearing member 100 provided with the circuit shown in FIG. 3 for the ink jet recording head shown in FIG. 2.

Figure 5:
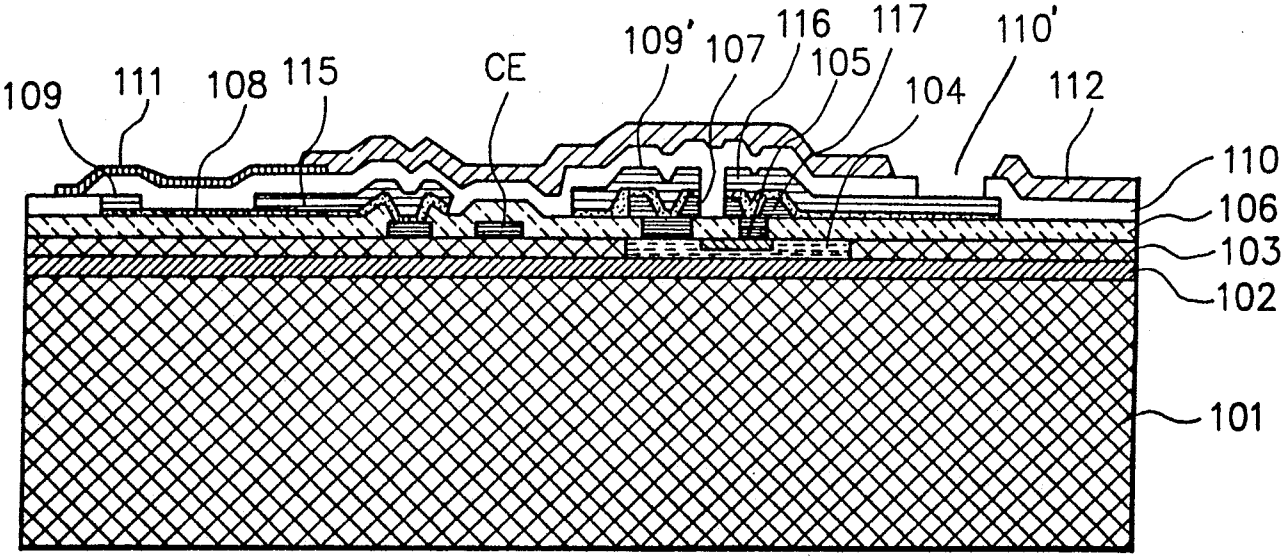
FIG. 5 is a schematic cross section view taken along line V—V' in FIG. 4.

In FIG. 4, there are shown only two heat generating elements H and only two diodes D for simplification purpose. FIG. 5 is a schematic cross section view taken along line V—V' in FIG. 4.

The element bearing member shown in FIGS. 4 and 5 comprises an insulating substrate 101, an insulating layer 102 disposed on said insulating substrate, and a semiconductor layer 104 and an insulating layer 103 which are arranged in parallel with each other on the insulating layer 102. On these layers is disposed a heat accumulating layer 106 through a common electric wiring CE, and on the heat accumulating layer 106 are arranged anode electrode 107, cathode electrode 117, heat generating resistive layer 108, common electrode 115, individual electrode 109 and cathode wiring 116. The surface of the element bearing member thus constituted is provided with protective layer 110, anti-cavitation layer 111 and another protective layer 112.

The protective layer 112 herein is disposed if required. The protective layer 112 is desired to be composed of an organic material such as polyimide, epoxy resin, etc.

The anti-cavitation layer 111 may be composed of a metal oxide such as tantalum oxide, aluminum oxide, etc., or a metal such as tantalum, aluminum, nickel, etc.

Each of the heat accumulating layer 106 and the protective layers 110 and 112 may be properly formed by means of a conventional sputtering method or a conventional CVD method.

Each of the heat generating resistive layer 108 and the anti-cavitation layer may be properly formed by means of a conventional sputtering method, a conventional CVD method or a conventional vacuum evaporation method.

Now, with reference to FIG. 6(*a*) through FIG. 6(*g*), an embodiment of the method of preparing a semiconductor-bearing substrate to be used in the present invention will be described.

As shown in FIG. 6(*a*), a silicon oxide layer 2 is selectively formed only at a corner of a p-type single-crystal silicon base member 1. The silicon oxide layer 2 in this case is formed at the position where an electrode is to be formed in the porous modification process which will be carried out later. Then, an n-type single-crystal silicon layer 3 is formed on the p-type single-crystal silicon base member 1 by means of a vapor epitaxial growing method, wherein the formation of an n-type polycrystal silicon layer 4 is caused on the silicon oxide layer 2, followed by subjecting the surface of the n-type single-crystal silicon layer 3 to thermal oxidation to form a silicon oxide layer 5. Successively, a phosphorous glass layer 6 is formed by subjecting the surface of the silicon oxide layer 5 to heat treatment in phosphorous vapor atmosphere whereby doping the surface with P. Thereafter, as shown in FIG. 6(*b*), the polycrystal silicon layer 4 and the silicon oxide layer 2 are removed by means of a photoetching technique while leaving the silicon oxide film 5 and the phosphorous glass layer 6 situated on the n-type single-crystal silicon layer 3. Thus, there is obtained a semiconductor-bearing base member of the configuration shown in FIG. 6(*b*).

The above procedures are repeated to obtain a plurality of semiconductor-bearing members respectively of the configuration shown in FIG. 6(*b*).

Separately, there is provided a glass substrate 7 (see, FIG. 6(*c*)). On the surface of the glass substrate 7 is formed a silicon oxide layer 8 by means of a conventional CVD method, followed by subjecting the surface of the silicon oxide layer 8 to heat treatment in phosphorous vapor atmosphere whereby doping the surface with P, to thereby form a phosphorous glass layer 9 on the silicon oxide layer 8.

Thus, there is obtained a semiconductor-bearing substrate of the configuration shown in FIG. 6(*c*).

The foregoing plurality of semiconductor-bearing members respectively of the configuration shown in FIG. 6(*b*) are contacted and bonded through the surfaces of their phosphorous glass layers 6 to the surface of the phosphorous glass layer 9 of the above semiconductor-bearing substrate of the configuration shown in FIG. 6(*c*) in a furnace maintained at about 1000 ° C., wherein the phosphorous glass layers 6 and 9 and the silicon oxide layers 5 and 8 are from the action of heat energy to convert into a single insulating layer 10 (see, FIG. 6(*d*)). As a result, there is obtained an assembled body of the configuration shown in FIG. 6(*d*).

Then, the p-type silicon member 1 of the assembled body is polished to thin it such that the p-type single-crystal silicon member 1 remains at a thickness corresponding to about 20 to 50 μm distance from the boundary with the n-type single-crystal silicon layer 3. And an electrode lead wire 11 is fixed to the portion behind the projected portion of the p-type single-crystal member 1, followed by covering not only the faces surrounding the portion where the electrode lead wire 11 is fixed but also the remaining side with an acidproof wax 12 as shown in FIG. 6(*e*).

Figure 6A:
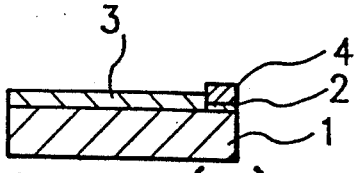
FIG. 6(*a*) through FIG. 6(*g*) are schematic explanatory views of an embodiment of the preparation process of a semiconductor-bearing member used in the method for manufacturing a recording head according to the present invention.
Figure 6B:
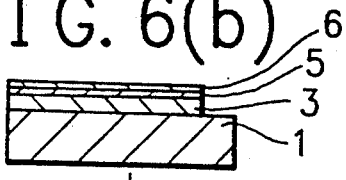
Figure 6C:
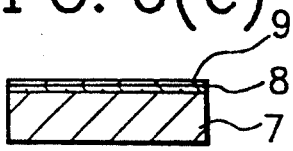
Figure 6D:
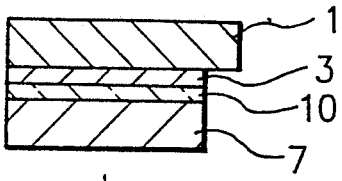
Figure 6E:
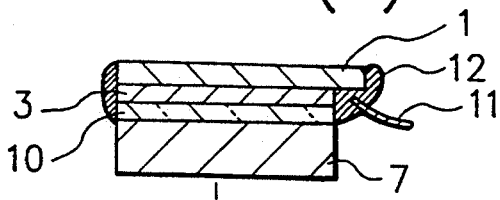
Figure 6F:
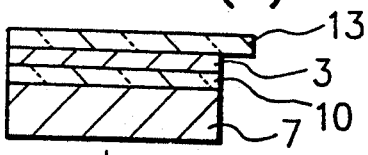
Figure 6G:
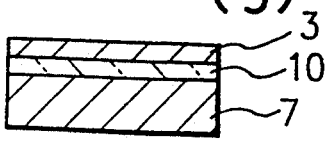
Figure 7:
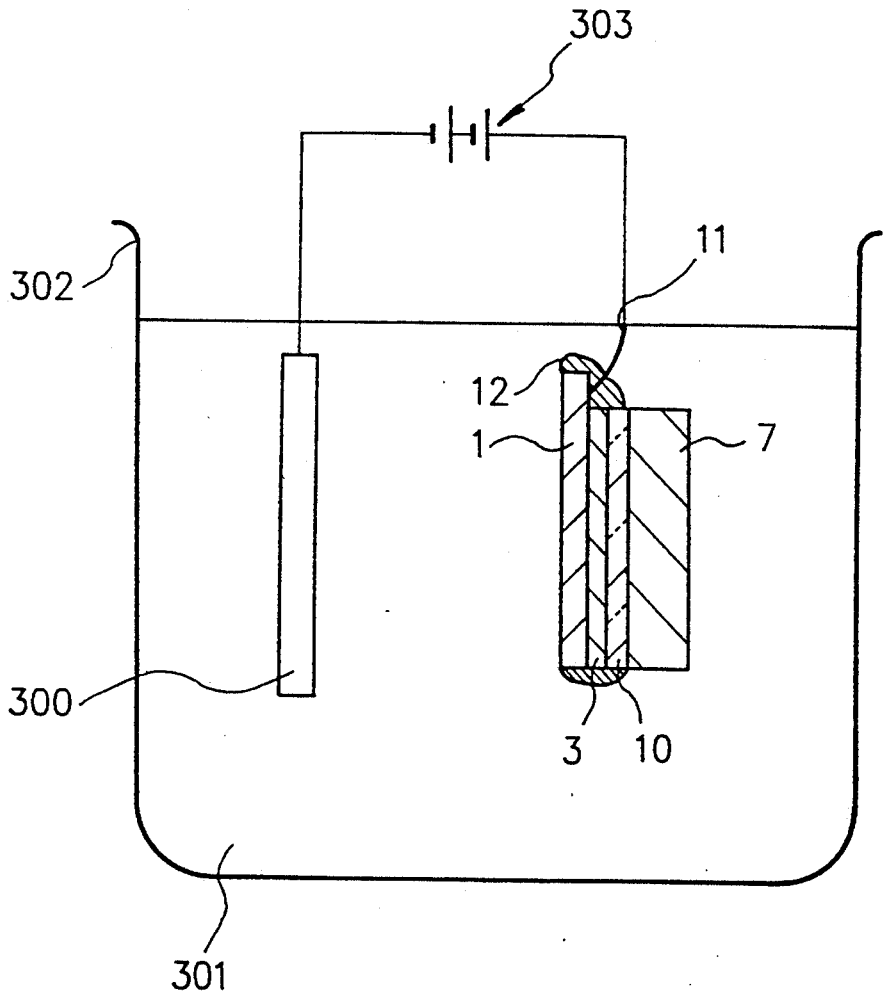
FIG. 7 is a schematic explanatory view of an anodizing device employed in the present invention.

Thereafter, the assembled body of the configuration shown in FIG. 6(*e*) is subjected to anodization using an anodizing device shown in FIG. 7. The anodizing device comprises a reaction vessel 302 containing a solution of hydrofluoric acid 301 therein. Numeral reference 300 stands for a counter electrode capable of serving as an cathode which is electrically connected to a power surce 303.

The assembled body is immersed in the solution of hydrofluoric acid 301 contained in the reaction vessel 302 as shown in FIG. 7, wherein the assembled body is designed to serve as an anode. The power source 303 is switched on to apply an electric field between the opposite electrodes to anodize the assembled body, wherein only the p-type single-crystal silicon member 1 of the assembled body is made to be in porous state. In this case, the n-type single-crystal silicon later 3 does not become porous since no electric current flows into the n-type single-crystal silicon layer 3 because of the presence of a pn junction between the n-type single-crystal silicon layer 3 and the p-type single crystal silicon member 1.

Thereafter, the acidproof wax 12 and the electrode lead wire 11 are removed, and the resultant is subjected to oxidation treatment using $H_2O$ steam to thereby oxidize the porous p-type single-crystal silicon member 1, whereby the porous p-type single-crystal silicon member 1 is converted into a silicon oxide layer 13 (see, FIG. 6(*f*)). The n-type single-crystal silicon layer 3 is not oxidized since it is not in porous state.

Thus, there is obtained a stacked body shown in FIG. 6(*f*) which comprises the insulating layer 10, the n-type single-crystal silicon layer 3 and the silicon oxide layer 13 being stacked in this order on the glass substrate 7.

Subsequently, the entire silicon oxide layer 13 of the stacked body obtained in the above is removed. As a result, there is obtained a semiconductor-bearing substrate of the configuration shown in FIG. 6(*g*) which comprises the n-type single-crystal silicon layer 3 with a precisely controlled thickness stacked on the insulating layer 10 disposed on the glass substrate 7.

The above description is of the case of forming an n-type single-crystal silicon layer. It is a matter of course that the above procedures are applicable also in the case of forming a p-type single-crystal silicon layer. In that case, all the conduction types employed in the above are inverted and instead of the phosphorous layer, there is used a borosilicate glass layer formed by subjecting the surface of the silicon oxide layer to heat treatment in boron vapor atmosphere whereby doping the surface with B.

Figure 8:
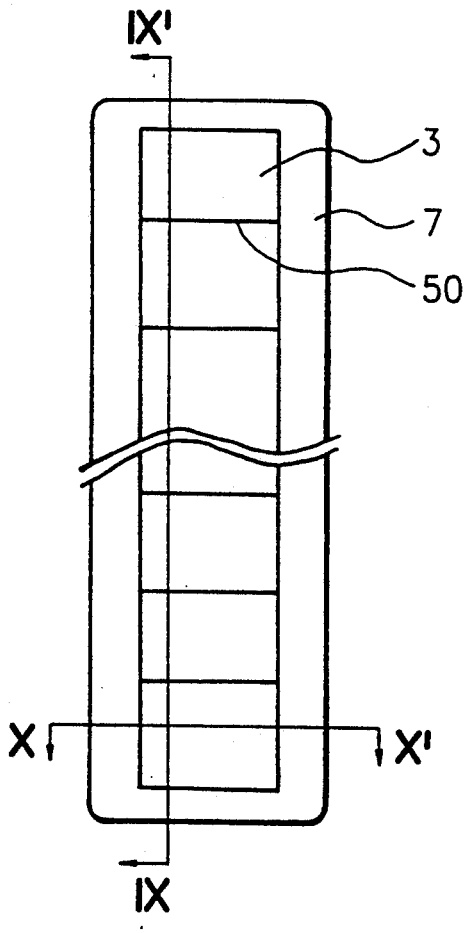
FIG. 8 is a schematic plan view illustrating the constitution of a semiconductor-bearing member used in the present invention.
Figure 9A:
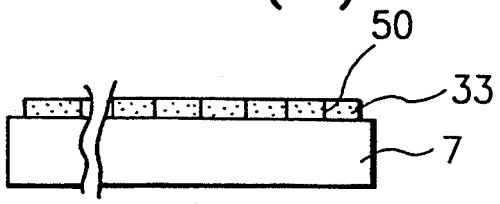
FIG. 9(*a*) through FIG. 9(*d*) are schematic explanatory views of an embodiment of the method for manufacturing a recording head according to the present invention.
Figure 9B:
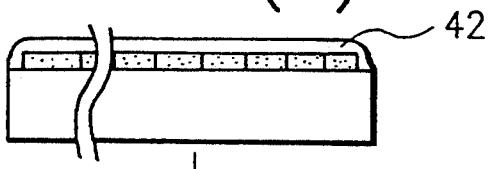
Figure 9C:
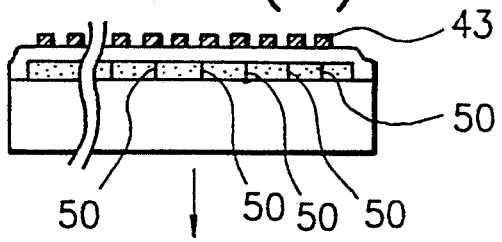
Figure 9D:
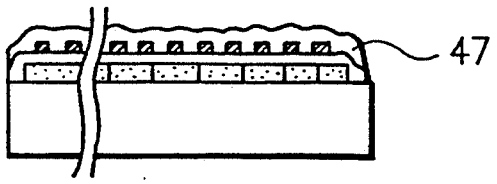
Figure 10A:
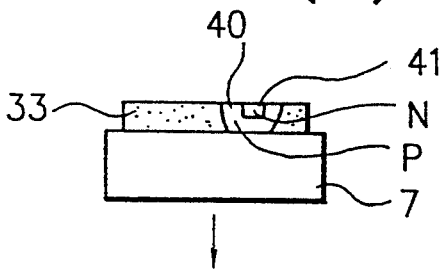
FIG. 10(*a*) through FIG. 10(*d*) are schematic explanatory views of another embodiment of the method for manufacturing a recording head according to the present invention.
Figure 10B:
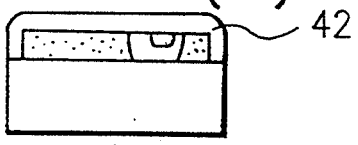
Figure 10C:
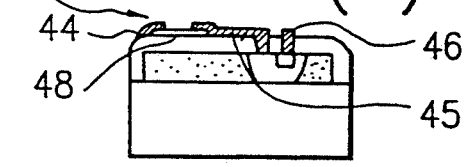
Figure 10D:
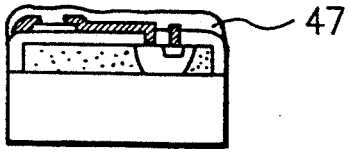

FIG. 8 is a schematic plan view illustrating the constitution of an example of the semiconductor-bearing substrate obtained in the above, which comprises a plurality of single-crystal silicon layer regions 3 arranged on a glass substrate 7. Numeral reference 50 in the figure stands for a boundary between the adjacent single-crystal silicon layer regions 3. There is not any particular restriction as for the boundary 50 and it is possible to arrange those single-crystal silicon layer regions such that they are situated apart from each other since an insulating layer is formed to cover all over the surfaces of those single-crystal silicon layer regions and an electrothermal transducer is then formed as will be described later.

As for the boundary 50 between the adjacent single-crystal silicon layer regions 3, it is desired to be designed such that it serves as an isolation region. Such isolation region may be formed by subjecting the corresponding peripheries of the adjacent single-crystal silicon layer regions 3 to thermal oxidation.

In the following, description will be made of the process of manufacturing a recording head using the semiconductor-bearing substrate shown in FIG. 8, while referring to FIGS. 9(*a*) to 9(*d*) and FIGS. 10(*a*) to 10(*d*).

FIGS. 9(*a*) to 9(*d*) are corresponding to the cross section along line IX—IX' n FIG. 8, and FIGS. 10(*a*) to 10(*d*) are corresponding to line X—X'in FIG. 8.

As for each of the single-crystal silicon semiconductor layer regions arranged on an insulating surface of the substrate 7 (made of glass, for example), boron ions are implanted into the sigle-crystal silicon semiconductor layer region to form a p-type anode region 40, followed by implanting phosphorous ions into the p-type anode region 40 to form a cathode region 41 comprising an $n^+$-type semiconductor within the p-type anode region 40 (see, FIG. 10(*a*)). The remaining layer region portion other than the portion where the p-type anode region 40 and the cathode region 41 have been formed is subjected to thermal oxidation to convert it into a silicon oxide layer 33. Thus, there is obtained a thin film diode which is isolated by way of discrete insulation in each case as shown in FIG. 9(*a*) and FIG. 10(*a*). 32 thin film diodes of the above configuration are formed in each of 54 single-crystal silicon semiconductor layer regions for example.

Then, as shown in FIG. 9(*b*) and FIG. 10(*b*), an insulating layer is formed to cover all over the surfaces of the layer regions 33 by means of a conventional CVD method.

Thereafter, a heat generating resistive layer 48 to be the electrothermal transducer is formed by depositing a heat generating resistive material and patterning it. A contact hole is formed at the insulating layer 42 by subjecting the insulating layer to etching treatment, followed by depositing an electrode material, which is then patterned. In this way, $32 \times 54$ pieces of electrothermal transducer 43 are formed on the insulating layer 42, as shown in FIG. 9(*c*) and FIG. 10(*c*). In FIG. 10(*c*), numeral reference 44 stands for a common electrode which is shared by each of the blocks, numeral reference 45 stands for an individual electrode, and numeral reference 46 stands for a cathode electrode which is shared by each of the segments. In FIG. 9(*c*), there are illustrated only ten of the electrothermal transducers for simplification purpose. It should be understood that among the plurality of the electrothermal transducers, some of them are positioned over the single-crystal silicon semiconductor layer regions while some others are positioned over the boundaries of the single-crystal silicon semiconductor layer regions. Particularly in this respect, as long as the thin film diodes have been once formed within the single-crystal silicon semiconductor layer region, the electrothermal transducers can be properly formed without having a particular due care about the presence of the boundaries between the single-crystal silicon semiconductor layer regions. That is, there is an advantage that the accuracy is remarkably softened for the alignment of a plurality of electrothermal transducers, and those electrothermal transducers can be properly arranged at an even interval at a widened freedom.

Lastly, a protective layer 47 is formed as shown in FIG. 9(*d*) and FIG. 10(*d*).

Thus, there is obtained a desirable recording head capable of generating thermal energy.

According to the above embodiment of manufacturing a recording head using the semiconductor-bearing substrate shown in FIG. 8, it is possible to increase the density of elements to be arranged per unit area and to minimize the area of the element bearing member, and because of this, miniaturization of the recording head can be attained as desired even if it is of the so-called full-line type and there can be produced a desirable recording head at a reduced cost. In addition, it is possible to arrange a plurality of single-crystal silicon layers on any kind of substrates, and because of this, a large area element bearing member comprising a plurality of high power electric functional elements arranged on a large area substrate can be desirably prepared. Thus, it is possible to desirably prepare a high on-peak power device of a full-line integrated type such as a bubble jet recording head which has such a configuration that a plurality of electrically functional elements are integrally housed. In short in this respect, miniaturization of a full-line integrated type device can be easily attained.

In addition to the above advantages, there is also an advantage that a reliable full-line integrated type recording head can be produced at a reduced cost without using any costly IC.

Further in addition, as the electrothermal transducer serving as a heater can be structurally stacked over the single-crystal silicon layer through the insulating layer as the heat accumulating layer, there is caused no problem even if the heater (that is, the electrothermal transducer) is situated over the boundaries among the semiconductor single-crystal layer regions as long as at least a semiconductor functional element is contained in each of the semiconductor single-crystal layer regions.

Further, as apparent from what is above described, the single-crystal semiconductor layer region comprises a very thin film and the element isolating layer reaches the silicon oxide layer situated thereunder upon forming it in order to establish an isolated active region in which a diode or a transistor is formed, and because of this, it is not necessary to employ any pn-junction isolation, wherein problems relative to latch-up and the like are therefore never caused.

The foregoing recording head of the configuration shown in FIG. 9(*d*) and FIG. 10(*d*) itself may be used as a thermal head.

In the case where a top plate member is affixed to the foregoing recording head of the configuration shown in FIG. 9(*d*) and FIG. 10(*d*) as shown in FIG. 2, there is afforded an ink jet recording head.

In the following, another embodiment of the method of preparing a semiconductor-bearing substrate to be used in the present invention will be described, with reference to FIG. 11 (*a*) through FIG. 11(*c*). Shown in FIG. 11(*a*) through FIG. 11(*c*) is of the case where a single base member is used for simplification purpose.

Figure 11A:
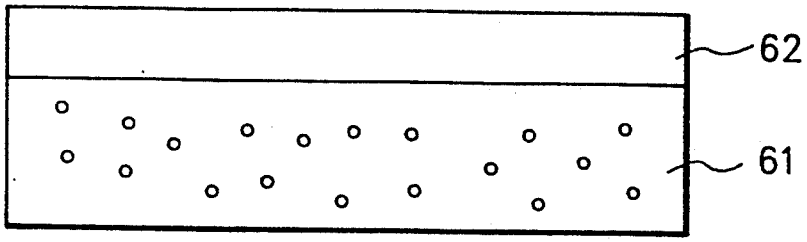
FIG. 11(*a*) through FIG. 11(*c*) are schematic explanatory views of another embodiment of the preparation process of a semiconductor-bearing member used in the method for manufacturing a recording head according to the present invention.
Figure 11B:
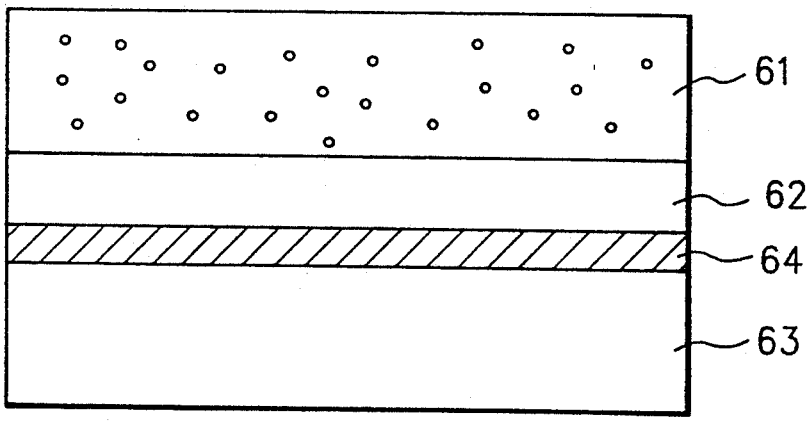
Figure 11C:
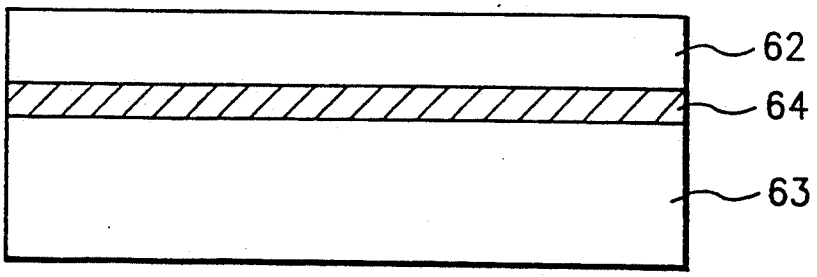
Figure 12A:
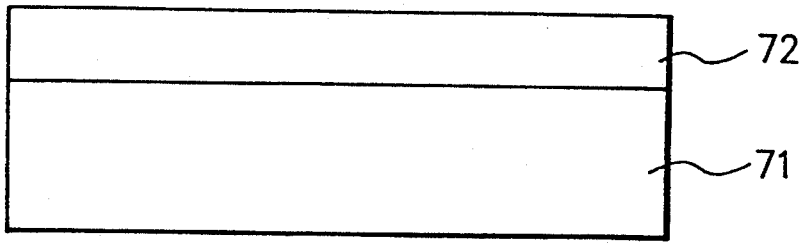
FIG. 12(*a*) through FIG. 12(*d*) are schematic explanatory views of a further embodiment of the preparation process of a semiconductor-bearing member used in the method for manufacturing a recording head according to the present invention.
Figure 12B:
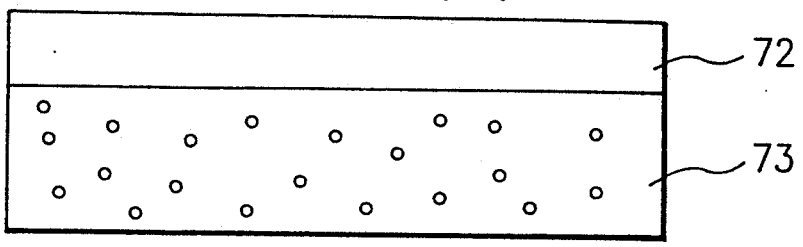
Figure 12C:
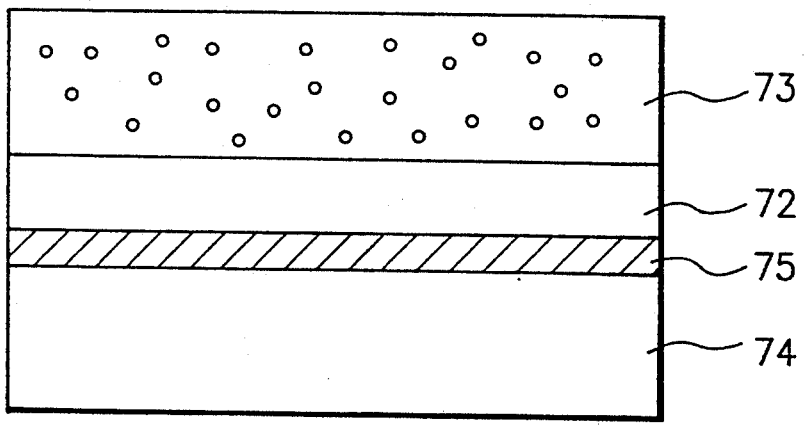
Figure 12D:
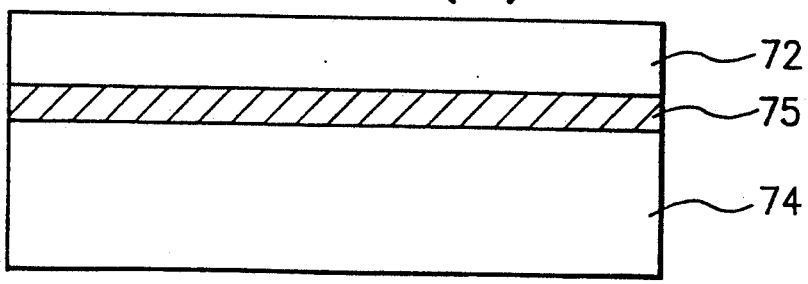

Firstly, as shown in FIG. 11(*a*), there is provided a p-type single-crystal silicon base member. The p-type single-crystal silicon base member is subjected to anodization in the same manner as in the above case wherein the anodizing device shown in FIG. 7 is used, whereby making it to be in porous state. In this case, the single-crystal silicon base member of 2.33 g/cm$^3$ in density is converted into a porous silicon member 61 (see, FIG. 11(*a*)) with a density in the range of 1.1 to 0.6 g/cm$^3$ by controlling the concentration of the solution of HF in the range of 50 to 20% in the anodization. On the porous surface of the porous member obtained is formed a single-crystal silicon thin layer 62 by means of an epitaxial growing method (see, FIG. 11(*a*)). Thus, there is obtained a semiconductor-bearing base member comprising the porous silicon member 61 and the single-crystal silicon layer 62 stacked on the porous silicon member (see, FIG. 11(*a*)).

Separately, there is provided a substrate 63 comprising a single-crystal silicon member (see, FIG. 11(*b*)). On the single-crystal silicon substrate 63 is formed a silicon oxide layer 64 (see, FIG. 11(*b*)). Thus, there is obtained a semiconductor-bearing substrate comprising the single-crystal silicon substrate 63 and the silicon oxide later 64 stacked thereon.

Then, the semiconductor bearing base member is bonded through the single-crystal silicon layer 62 to the surface of the silicon oxide layer 64 of the semiconductor-bearing substrate to thereby obtain an assembled body as shown in FIG. 11(*b*). This affixing step is desired to be conducted in a gaseous atmosphere comprising nitrogen gas, inert gas or a mixture of these gases in a furnace maintained at elevated temperature.

Subsequently, the entire porous silicon base member 61 is removed by means of a selective etching method using an etchant such as an aqueous solution of sodium hydroxide, an aqueous solution of potassium hydroxide or an aqueous solution containing hydrofluoric acid, nitric acid and acetic acid so that the entire single-crystal silicon layer remains without being etched off.

In this selective etching step, it is possible to protect other portions than the porous silicon base member by an appropriate etching preventive member in order to prevent those portions from being effected by said etchant.

Thus, there is obtained a semiconductor-bearing substrate of the configuration shown in FIG. 11(*c*) which comprises the silicon oxide layer 64 (that is, an insulating layer) and the single-crystal silicon layer 62 being stacked in this order on the single-crystal silicon substrate 63.

In this embodiment, as above described, the porous semiconductor layer (that is, the porous silicon base member 61) is removed by means of an etching technique without subjecting it to thermal oxidation treatment, and because of this, there is not any occasion for the porous semiconductor layer to be expanded into the single-crystal silicon layer 62 situated thereunder due to the action of heat upon performing the thermal oxidation treatment, wherein the single-crystal silicon layer is maintained in a stable state.

Further in addition, according to this embodiment, a desirably thin single-crystal layer having a crystallinity equivalent to that of a silicon wafer (the single-crystal silicon base member) can be formed uniformly over the entire surface of the substrate.

As for the thickness of the non-porous semiconductor single-crystal layer formed on the porous semiconductor base member, it is desired to be preferably 50 μm or less or more preferably 20 μm or less in the case of producing a thin film semiconductor device.

In this embodiment, the foregoing stacked substrate member comprising the single-crystal silicon substrate 63 and the silicon oxide layer 64 (that is, the insulating layer) stacked thereon may be replaced by other member such as a member having an insulating surface or a member composed of an insulating material.

As such member having an insulating surface, there can be illustrated a single-crystal silicon member having an insulating surface obtained by subjecting the surface of a single-crystal silicon member to thermal oxidation to thereby form an insulating layer composed of silicon oxide on the single-crystal silicon member or a polycrystal silicon member having an insulating surface obtained by subjecting the surface of a polycrystal silicon member to thermal oxidation to form an insulating layer composed of silicon oxide on the polycrystal silicon member. Other than these, there can be also illustrated other conductive or semiconductor members respectively having an insulating surface layer composed of, for example, oxide, nitride or boride.

As such member composed of an insulating material, there can be illustrated a member made of quartz glass, a member made of sintered alumina, and the like.

Further, in this embodiment, the foregoing stacked base member comprising the porous silicon base member 61 and the single-crystal silicon layer 62 stacked thereon may be replaced by another appropriate stacked member comprising, for example, a single-crystal layer which is hardly made to be in porous state (for example, comprised of an n-type single-crystal silicon layer) and a layer which can easily be made in porous state (for example, comprised of a p-type silicon layer) when subjected to the anodization.

The single-crystal layer of the semiconductor-bearing member obtained in this embodiment, which is of $5.0\times10^{-4}$ sec or more with respect to the life time of carrier, is surpassing the semiconductor single-crystal layer obtained by SIMOX with respect to crystalline defects such as through transition, etc., and is extremely small in variation of the thickness. More specifically, the single-crystal layer is of $2\times10^{4}/cm^{2}$ or below in transition defect density. And as for the thickness thereof, the variation between the maximum thickness and the minimum thickness is less than 10% in a given area of 20 to 500 $cm^2$ with respect to the surface of the semiconductor single-crystal layer (that is, 2-inch sized wafer to 10-inch sized wafer in other words).

It is possible to prepare a desirable recording head by processing the semiconductor-bearing substrate thus obtained in the above in the manner shown in FIG. 9(*a*) through FIG. 9(*d*) and in FIG. 10(*a*) through FIG. 10(*d*).

In the following, a further embodiment of the method of preparing a semiconductor-bearing substrate to be used in the present invention will be described, with reference to FIG. 12 (*a*) through FIG. 12(*d*). Shown in FIG. 12(*a*) through FIG. 12(*d*) is of the case where a single base member is used for simplification purpose.

Firstly, there is provided a p-type single-crystal silicon base member 71 (see, FIG. 12(*a*)). On the p-type single-crystal silicon base member 71 is formed a single-crystal silicon layer 72 containing an impurity with a low concentration by an epitaxial growing method. In this case, the single-crystal silicon layer 72 may be replaced by an n-type single-crystal silicon layer formed by subjecting the surface of the p-type single-crystal silicon base member to ion implantation treatment wherein proton is implanted into the surface of the p-type single-crystal silicon base member. Thus, there is obtained a stacked base member of the configuration shown in FIG. 12(*a*).

Then, the p-type single-crystal silicon base member 71 of the stacked base member obtained in the above is subjected to anodization in the same manner as in the above case wherein the anodizing device shown in FIG. 7 is used, whereby converting it into a porous silicon base member 73 (see, FIG. 12(*b*)). In this case, the single-crystal silicon base member 71 of 2.33 $g/cm^3$ in density is converted into the porous silicon member 73 with a density in the range of 1.1 to 0.6 $g/cm^3$ by controlling the concentration of the solution of HF in the range of 50 to 20% in the anodizing treatment. Thus, there is obtained a semiconductor-bearing base member comprising the porous silicon member 73 and the single-crystal silicon layer 72 stacked on the porous silicon member (see, FIG. 12(*b*)).

Separately, there is provided a Si substrate 74 (see, FIG. 12(*c*)). On the Si substrate 74 is formed a silicon oxide layer (insulating layer) 75 (see, FIG. 12(*c*)). Thus, there is obtained a semiconductor-bearing substrate comprising the Si substrate 74 and the silicon oxide layer 75 stacked thereon.

Then, the semiconductor bearing base member is bonded through the single-crystal silicon layer 72 to the surface of the silicon oxide layer 75 of the semiconductor-bearing substrate to thereby obtain an assembled body as shown in FIG. 12(*c*). This affixing step is desired to be conducted in a gaseous atmosphere comprising nitrogen gas, inert gas or a mixture of these gases in a furnace maintained at elevated temperature.

Subsequently, the entire porous silicon base member 73 is removed by means of a selective etching method using an etchant such as an aqueous solution of sodium hydroxide, an aqueous solution of potassium hydroxide or an aqueous solution containing hydrofluoric acid, nitric acid and acetic acid so that the entire single-crystal silicon layer 72 remains without being etched off.

In this selective etching step, it is possible to protect other portions than the porous silicon base member by an appropriate etching preventive member in order to prevent those portions from being effected by said etchant.

Thus, there is obtained a semiconductor-bearing substrate of the configuration shown in FIG. 12(*d*) which comprises the silicon oxide layer 75 (that is, the insulating layer) and the single-crystal silicon layer 72 being stacked in this order on the Si substrate 74.

According to this embodiment, a desirably thin single-crystal layer having a crystallinity equivalent to that of a silicon wafer (the single-crystal silicon base member) can be formed uniformly over the entire surface of the substrate.

This embodiment is directed to a method of forming an n-type semiconductor layer on a p-type base member prior to subjecting the p-type base member to the anodization and then subjecting only the p-type base member to the anodization to thereby make it in porous state. The semiconductor-bearing substrate obtained in this embodiment exhibits desirable performances as well as the semiconductor-bearing substrate shown in FIG. 11(*c*).

It is possible to prepare a desirable recording head by processing the semiconductor-bearing substrate thus obtained in the above in the manner shown in FIG. 9(*a*) through FIG. 9(*d*) and in FIG. 10(*a*) through FIG. 10(*d*).

In the following, a still further embodiment of the method of preparing a semiconductor-bearing substrate to be used in the present invention will be described, with reference to FIG. 13 (*a*) through FIG. 13(*c*). Shown in FIG. 13(*a*) through FIG. 13(*c*) is the case where a single base member is used for simplification purpose.

Firstly, there is provided a p-type single-crystal silicon base member. The p-type single-crystal silicon base member is subjected to anodization in the same manner as in the above case wherein the anodizing device shown in FIG. 7 is used, whereby converting the p-type single-crystal silicon base member into a porous silicon base member 81 (see, FIG. 13(*a*)). In this case, the single-crystal silicon base member of 2.33 g/cm$^3$ in density is converted into the porous silicon base member 81 with a density in the range of 1.1 to 0.6 g/cm$^3$ by controlling the concentration of the solution of HF in the range of 50 to 20% in the anodization. On the porous surface of the porous base member obtained is formed a single-crystal silicon thin layer 82 by means of an epitaxial growing method (see, FIG. 13(*a*)). Thus, there is obtained a semiconductor-bearing base member comprising the porous silicon base member 81 and the single-crystal silicon layer 82 stacked on the porous silicon base member (see, FIG. 13(*a*)).

Figure 13A:
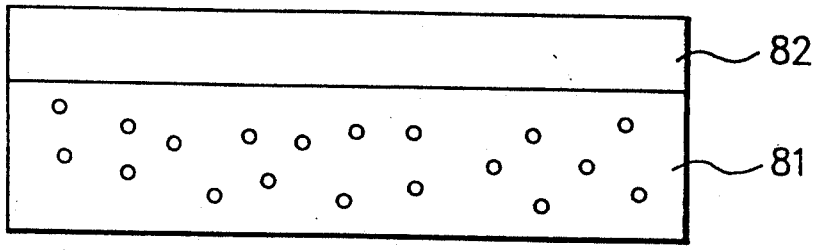
FIG. 13(*a*) through FIG. 13(*c*) are schematic explanatory views of a still further embodiment of the preparation process of a semiconductor-bearing member used in the method for manufacturing a recording head according to the present invention.
Figure 13B:
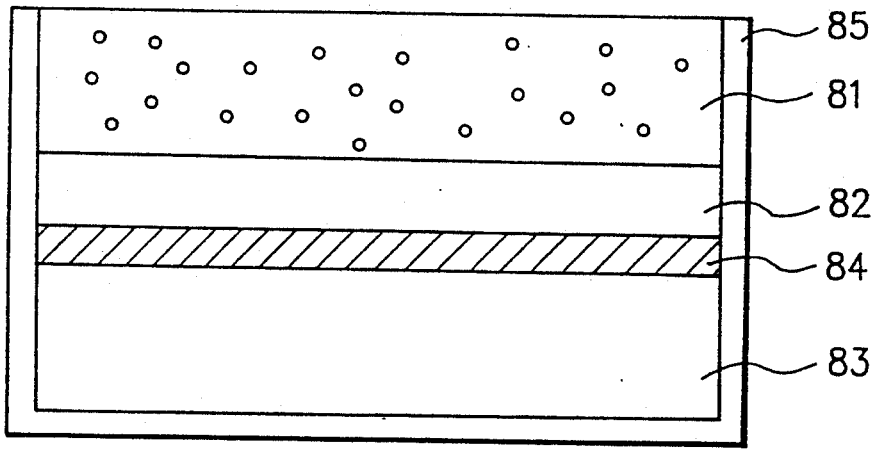
Figure 13C:
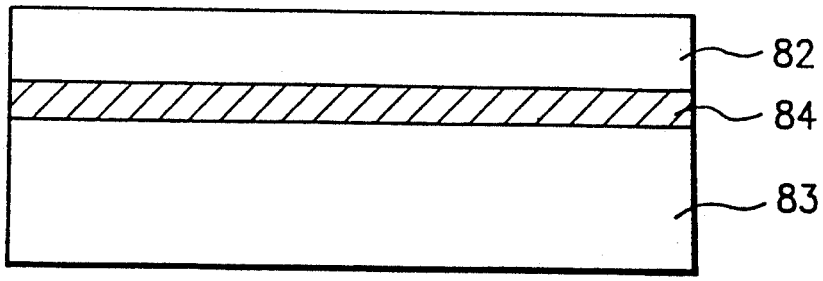

Separately, there is provided a Si substrate 83 (see, FIG. 13(*b*)). On the Si substrate 83 is formed a silicon oxide layer (insulating layer) 84 (see, FIG. 13(*b*)). Thus, there is obtained a semiconductor-bearing substrate comprising the Si substrate 83 and the silicon oxide layer 84 stacked the Si substrate.

Then, the semiconductor bearing base member is bonded through the single-crystal silicon layer 82 to the surface of the silicon oxide layer 84 of the semiconductor-bearing substrate to thereby obtain an assembled body (see, FIG. 13(*b*). This affixing step is desired to be conducted in a gaseous atmosphere comprising nitrogen gas, inert gas or a mixture of these gases in a furnace maintained at elevated temperature.

Subsequently, a $Si_3N_4$ layer 85 as an etching preventive layer is deposited so as to cover the entire exposed faces of the assembled body obtained in the above. In this case, it is possible to use abiezon wax instead of the $Si_3N_4$ layer.

The $Si_3N_4$ layer situated on the surface of the porous silicon base member 81 was removed by means of a lapping technique. Thus, there is obtained a structural body comprising the above assembled body covered by the $Si_3N_4$ layer 85 except the surface of the porous silicon base member 81 as shown in FIG. 13(*b*).

Then, the entire porous silicon base member 81 is removed by means of a selective etching method using an etchant such as an aqueous solution of potassium hydroxide so that the entire single-crystal silicon layer remains without being etched off. Subsequently, the entire remaining $Si_3N_4$ layer 85 is removed by means of a selective etching method using an aqueous solution containing hydrofluoric acid to thereby obtain a semiconductor-bearing substrate of the configuration shown in FIG. 13(*c*) comprising the silicon oxide layer 84 (that is, insulating layer) and the single-crystal silicon layer 82 being stacked in this order on the $Si_3N_4$ substrate 83.

According to this embodiment, a desirably thin single-crystal silicon layer having a crystallinity equivalent to that of a silicon wafer (the single-crystal silicon base member) can be formed uniformly over the entire surface of the substrate.

The semiconductor-bearing substrate obtained in this embodiment exhibits desirable performances as well as the semiconductor-bearing substrate shown in FIG. 11(*c*).

It is possible to prepare a desirable recording head by processing the semiconductor-bearing substrate thus obtained in the above in the manner shown in FIG. 9(*a*) through FIG. 9(*d*) and in FIG. 10(*a*) through FIG. 10(*d*).

In the following, the present invention will be described in more detail with reference to the following examples, which are not intended to restrict the scope of the invention only to these examples.

EXAMPLE 1

In this example, there was prepared an element bearing member and an ink jet recording head using the element bearing member.

In the preparation of the element bearing member, a semiconductor-bearing substrate was firstly prepared in the manner shown in FIGS. 6(*a*) through 6(*g*), and using the semiconductor-bearing substrate, the element bearing member was prepared in the manner shown in FIGS. 9(*a*) through 9(*d*) and FIGS. 10(*a*) through 10(*d*).

(1) Preparation of semiconductor-bearing substrate

Following the procedures shown in FIGS. 6(*a*) through 6(*g*), there was prepared a semiconductor-bearing substrate provided with a plurality of semiconductor layer regions.

There were firstly provided a plurality of p-type single-crystal silicon base members 1. As for each of the p-type single-crystal silicon base members, there was formed a silicon oxide layer 2 at a corner position of the surface thereof as shown in FIG. 6(*a*), where an electrode is to be formed. Then, an about 1 μm thick n-type single-crystal silicon layer 3 was formed on the p-type single-crystal base member 1 by means of a low pressure CVD method wherein epitaxial growth was performed, wherein the formation of an n-type polycrystal silicon layer 4 was caused on the silicon oxide layer 2. (see, FIG. 6(*a*))

The surface of the n-type single-crystal silicon layer 3 was subjected to thermal oxidation to form a 100 nm thick silicon oxide layer 5 on the n-type single-crystal silicon layer 3, followed by subjecting the surface of the silicon oxide layer 5 to heat treatment in phosphorous vapor atmosphere to dope said surface with P whereby an about 50 nm thick phosphorous glass layer 6 was formed on the silicon oxide layer 5. (see, FIG. 6(*b*))

Then, the polycrystal silicon layer 4 and the silicon oxide layer 2 were removed by means of a photolithography technique. Thus, there were obtained a plurality of semiconductor-bearing base members respectively of the configuration shown in FIG. 6(*b*).

Separately, there was provided a glass substrate 7 (see, FIG. 6(*c*)). On the surface of the glass substrate 7 was formed a 100 nm thick silicon oxide layer 8 by means of a conventional CVD method, followed by subjecting the surface of the silicon oxide layer 8 to heat treatment in phosphorous vapor atmosphere to dope the surface of the silicon oxide layer with P whereby an about 50 nm thick phosphorous glass layer 9 was formed on the silicon oxide layer 8. Thus, there was obtained a semiconductor-bearing substrate of the configuration shown in FIG. 6(*c*).

The above plurality of semiconductor-bearing base members respectively of the configuration shown in FIG. 6(*b*) were contacted and bonded through the surfaces of their phosphorous glass layers 6 to the surface of the phosphorous glass layer 9 of the above semiconductor-bearing substrate of the configuration shown in FIG. 6(*c*) in a furnace maintained at about 1000 ° C., wherein the phosphorous glass layers 6 and 9 and the silicon oxide layers 5 and 8 were caused by the action of heat energy to convert into a single insulating layer 10 (see, FIG. 6(*d*)). Thus, there was obtained an assembled body of the configuration shown in FIG. 6(*d*).

Then, each of the p-type single-crystal silicon base members 1 of the assembled body was polished to thin it such that the p-type single-crystal silicon base member remained at a thickness corresponding to about 20 μm distance from the boundary with the n-type single-crystal silicon layer 3. Subsequently, an electrode lead wire 11 was fixed to the portion behind the projected portion of the p-type single-crystal silicon base member 1, followed by covering not only the faces surrounding the portion where the electrode lead wire 11 was fixed but also the remaining side with an acidproof wax 12 as shown in FIG. 6(*e*).

The assembled body of the configuration shown in FIG. 6(*e*) was subjected to anodization using the anodizing device shown in FIG. 7 containing an aqueous solution of hydrofluoric acid in the reaction vessel thereof in the same manner as in the case previously described, wherein only the remaining p-type single-crystal silicon base member 1 of about 20 um in thickness was made to be in porous state.

Thereafter, the acidproof wax 12 and the electrode lead wire 11 were removed, and the resultant was subjected to oxidation treatment using $H_2O$ steam to thereby oxidize only the porous p-type silicon base member 1, whereby the porous p-type silicon base member 1 was converted into a silicon oxide layer 13 (see, FIG. 6(*f*)). The n-type single-crystal silicon layer 3 was not oxidized since it was not in porous state.

The entire silicon oxide layer 13 thus formed was removed by means of an etching technique.

Thus, there was obtained a semiconductor-bearing substrate provided with a plurality of the single-crystal silicon layer regions 3 respectively of about 1 um in thickness being arranged on the silicon oxide layer 10 disposed on the glass substrate 7 (see, FIG. 6(*g*)). This semiconductor-bearing substrate is of the configuration shown in FIG. 8. This semiconductor-bearing substrate will be hereinafter referred to as "SOI substrate".

(2) Preparation of a recording head

There was prepared a recording head of the configuration shown in FIG. 5 using the SOI substrate obtained in the above (1).

As for each of the single-crystal silicon semiconductor layer regions arranged on the silicon oxide layer 10 (102 in FIG. 5) disposed on the glass substrate 7 (101 in FIG. 5) of the SOI substrate, boron ions were implanted selectively into the single-crystal silicon semiconductor layer region to form a p-type anode region 104, followed by implanting phosphorous ions into the p-type anode region 104 to form a cathode region 105 comprising an $n^+$-type semiconductor within the p-type anode region 104. The remaining single-crystal silicon layer region other than the portion where the p-type anode region 104 and the cathode region 105 had been formed was subjected to thermal oxidation to thereby convert it into a silicon oxide layer serving as an element isolation layer 103. In this way, there were formed 32×54 cross-talk preventive diodes.

On the element isolation layer 103 was formed an about 500 nm thick Al layer by means of a conventional sputtering technique, followed by subjecting the Al layer to patterning, to thereby form a common wiring CE. Then, there was formed an about 1 μm thick silicon oxide layer 106 by means of a conventional CVD method. A contact hole was formed not only at the position of the silicon oxide layer 106 under which the p-type anode region 104 is situated but also at the position of the silicon oxide layer 106 under which the cathode region 105 is situated. Subsequently, an about 500 nm thick Al layer was formed by means of a conventional sputtering method, followed by subjecting the Al layer to patterning to thereby form Al electrodes 107 and 117. Then, an about 100 nm thick hafnium boride layer 108 to be the heat generating resistive layer was formed by means of a conventional sputtering method, followed by forming an about 100 nm thick Al layer by means of a conventional sputtering method. The hafnium boride layer and the Al layer were patterned to thereby form Al electrodes 109, 109', 115 and 116, wherein 32×52 rectangular heat generating portions respectively comprising the hafnium boride layer portion (to be a heat generating face) of 30 μm×150 μm in size exposed from the Al electrodes 109 and 115 were formed as shown in FIG. 4 and FIG. 5.

Then, there was formed an about 1 μm thick silicon oxide layer as a protective layer 110 by means of a conventional bias sputtering method. There was formed a spaced portion 110' for the electrical connection with an external system at the protective layer 110. There was formed an about 500 nm thick Ta layer by a conventional sputtering method wherein a Ta-target was used, followed by patterning the Ta layer to thereby form an anti-cavitation layer 111. Thereafter, photosensitive polyimide was applied onto the entire surface, followed by subjecting the photosensitive polyimide applied to exposure, development and postbaking treatments to thereby form a protective layer 112.

Thus, there was obtained an element bearing member for recording head.

(3) Preparation of an ink jet recording head

A top plate member of the configuration shown in FIG. 2 was fixed to the element bearing member obtained in the above (2), to thereby obtain an ink jet recording head having a ink discharging outlet face of 210 mm length which is corresponding to the width of a A4 size recording medium.

EXAMPLE 2

In this example, there was prepared an element bearing member and an ink jet recording head using the element bearing member.

In the preparation of the element bearing member, a semiconductor-bearing substrate was firstly prepared in the manner shown in FIGS. 11(*a*) through 11(*c*), and using the semiconductor-bearing substrate, the element bearing member was prepared in the manner shown in FIGS. 9(*a*) through 9(*d*) and FIGS. 10(*a*) through 10(*d*).

(1) Preparation of semiconductor-bearing substrate

Following the procedures shown in FIGS. 11(*a*) through 11(*c*), there was prepared a semiconductor-bearing substrate provided with a plurality of semiconductor layer regions.

There was firstly provided a single-crystal silicon base member.

The single-crystal silicon base member was subjected to anodization in the same manner as in the previously described case wherein the anodizing device shown in FIG. 7 was used, whereby making it to be in porous state to form a porous silicon base member 61 (see, FIG.

11(*a*)). On the porous surface of the porous silicon base member 61 was formed an about 1.5 μm thick single-crystal silicon layer 62 by means of a vapor phase epitaxial growing method (see, FIG. 11(*a*)). Thus, there was obtained a semiconductor-bearing base member of the configuration shown in FIG. 11(*a*).

Separately, there was provided a single-crystal silicon substrate 63 (see, FIG. 11(*b*)). On the single-crystal silicon substrate 63 was formed an about 100 nm thick silicon oxide layer 64 by means of a thermal oxidation technique (see, FIG. 11(*b*)). Thus, there was obtained a semiconductor-bearing substrate comprising the single-crystal silicon substrate 63 and the silicon oxide layer 64 stacked thereon.

The semiconductor-bearing base member was bonded through the surface of the single-crystal silicon layer 62 to the surface of the silicon oxide layer 64 of the semiconductor-bearing substrate in a gaseous atmosphere comprising nitrogen gas in a furnace maintained at 800 ° C., to thereby obtain a stacked body of the configuration shown in FIG. 11(*b*).

Then, the entire porous silicon base member 61 was removed by means of a selective etching method using an etchant comprising an aqueous solution of potassium hydroxide. Thus, there was obtained a semiconductor-bearing substrate of the configuration shown in FIG. 11(*c*) comprising the silicon oxide layer 64 and the single-crystal silicon layer 62 being stacked in this order on the single-crystal silicon substrate 63.

(2) Preparation of a recording head

Figure 14:
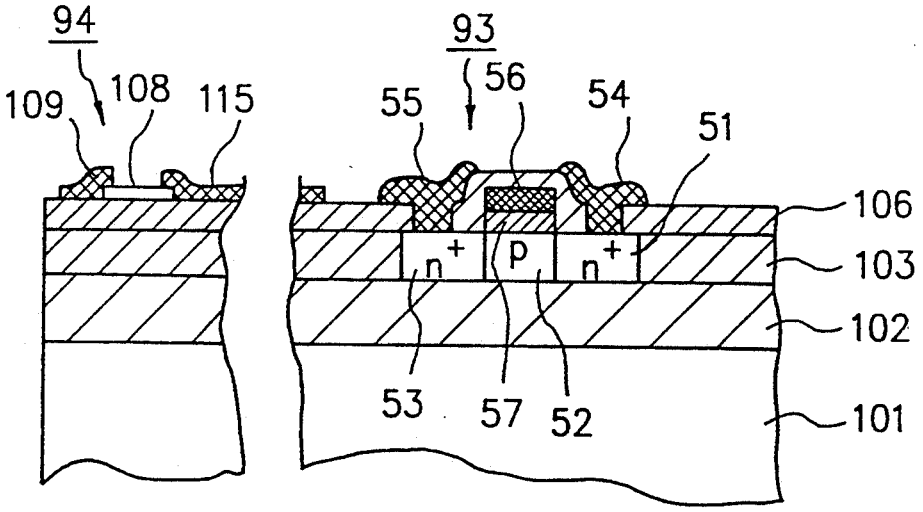
FIG. 14 is a schematic cross section view illustrating the constitution of another embodiment of the recording head to be provided according to the present invention.

There was prepared a recording head of the configuration shown in FIG. 14 using the semiconductor-bearing substrate obtained in the above (1).

As for the single-crystal silicon semiconductor layer stacked on the silicon oxide layer 64 (102 in FIG. 14) disposed on the single-crystal silicon substrate 63 (101 in FIG. 14) of the semiconductor-bearing substrate, boron ions were implanted selectively into the single-crystal silicon semiconductor layer to form a p-type region for the formation of a channel for MOS transistor. The remaining single-crystal silicon layer region other than the portion where the p-type region had been formed was subjected to thermal oxidation to thereby convert it into a silicon oxide layer serving as an element isolation layer 103. Subsequently, there was formed a silicon oxide layer to be a gate insulating layer 57. On the silicon oxide layer thus formed was formed an Al layer, followed by subjecting the Al layer to patterning to form a gate electrode 56. Then, using the gate electrode as part of a mask, there were formed a source region 53 and a drain region 51 by means of a conventional self-alignment process wherein phosphorous ions were implanted. Thus, there was formed a MOS transistor.

Then, an about 1 μm thick silicon oxide layer 106 was formed by means of a conventional CVD method. An about 100 nm thick layer comprising Ta—Al alloy was then formed by a conventional sputtering method, followed by subjecting the Ta—Al alloy layer to patterning to thereby form a heat generating resistive layer 108. Contact holes for the source and drain regions were formed at the silicon oxide layer 106 by means of a conventional dry etching method.

An about 1 μm thick Al layer was formed by a conventional sputtering method, followed by subjecting the Al layer to patterning to thereby form a common electrode for electrothermal transducer, an individual electrode 115, a source electrode 54 and a drain electrode 55.

Thus, there was obtained an element-bearing member of the configuration shown in FIG. 14 for recording head.

(3) Preparation of an ink jet recording head

A top plate member of the configuration shown in FIG. 2 was fixed to the element bearing member obtained in the above (2), to thereby obtain an ink jet recording head.

Figure 15:
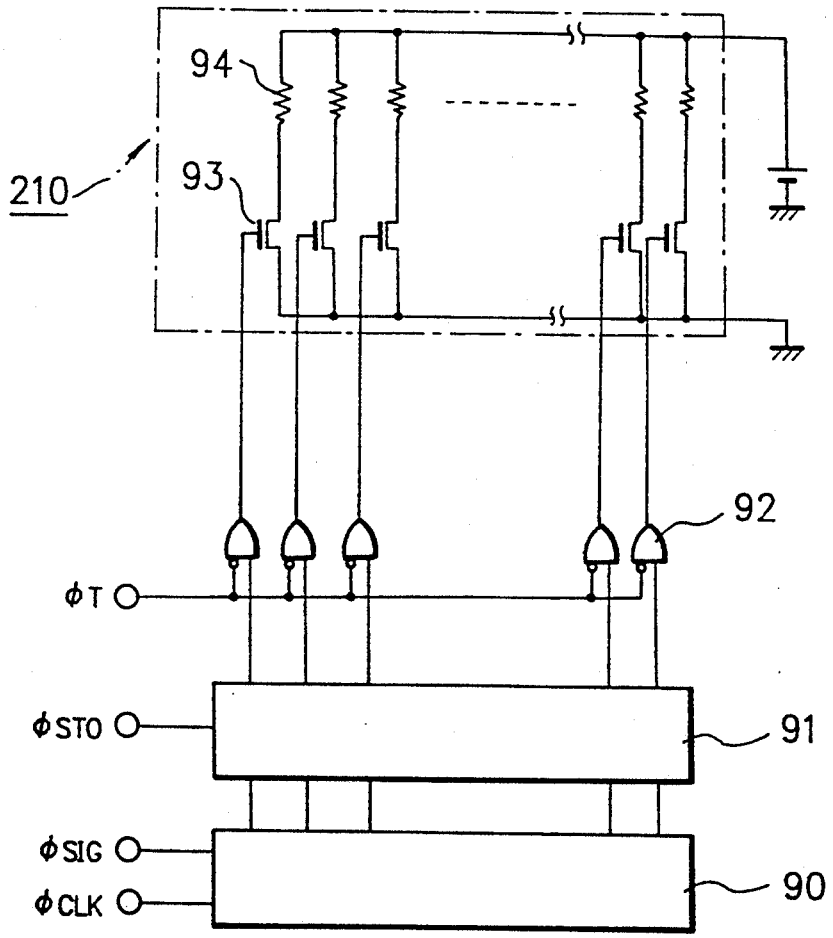
FIG. 15 is a schematic diagram illustrating the circuit for the recording head shown in FIG. 14 and the peripheral circuit thereof.
Figure 16:
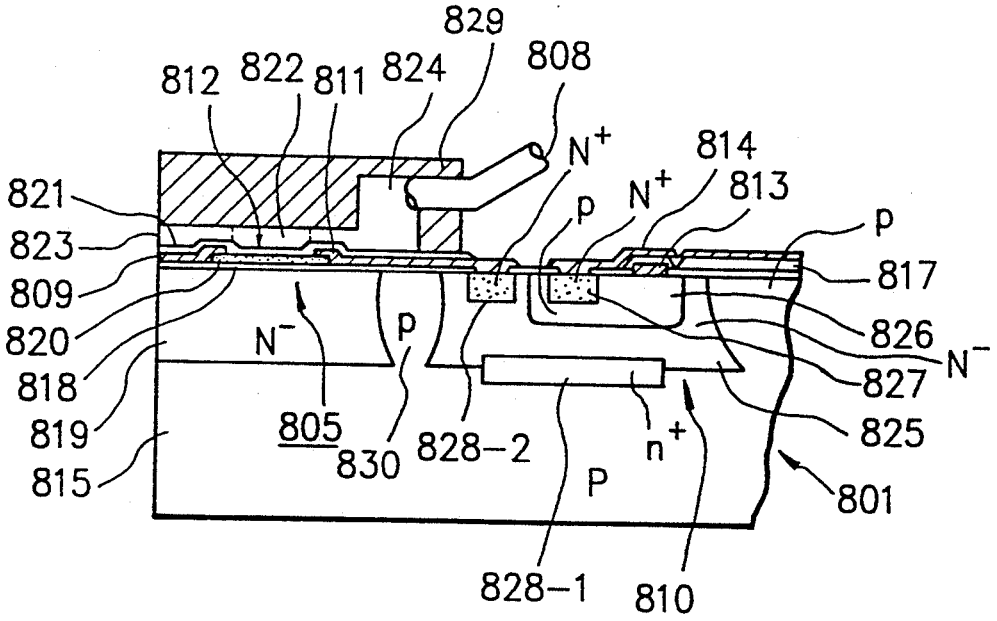
FIG. 16 PRIOR ART
FIG. 16 is a schematic view illustrating the constitution of a conventional recording head.
Figure 17:
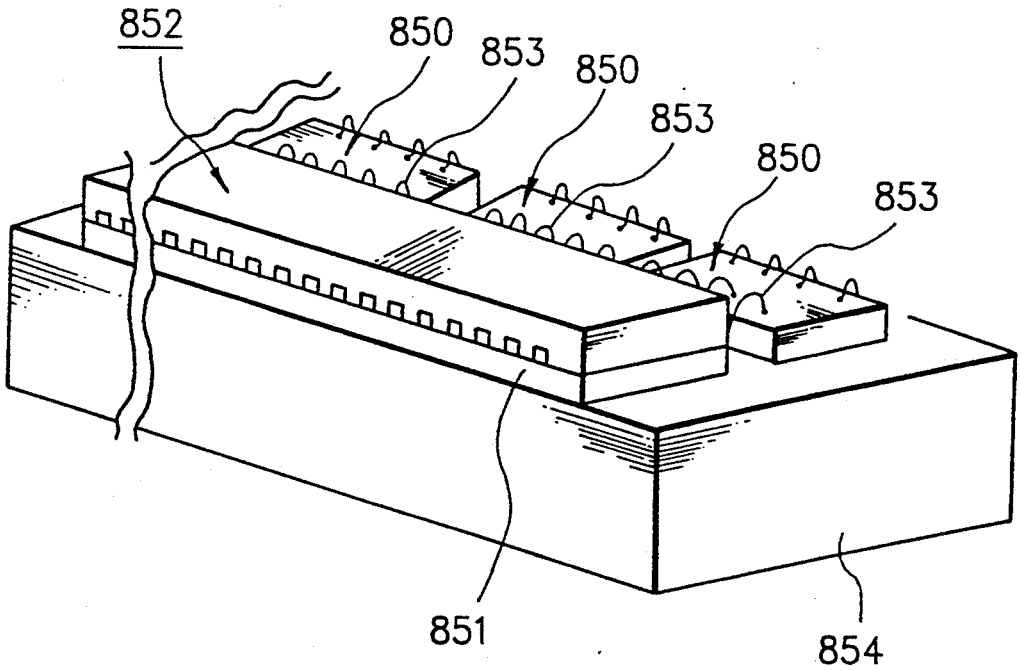
FIG. 17 PRIOR ART
FIG. 17 is a schematic perspective view illustrating the constitution of another conventional recording head.

FIG. 15 is a schematic circuit diagram illustrating Constitution of the driving circuit for the recording head according to the present invention.

Each of the electrothermal transducers 94 of a recording head 210 is energized by a MOS transistor 93 which serves as a switching element and generates thermal energy for discharging ink.

The MOS transistor 93 is driven by a circuit comprising a shift register 90, latch circuit 91, and AND circuit 92. Particularly, while recording signals are inputted into the terminal $\Phi_{SIG}$, the clocking signals are inputted into the terminal $\Phi_{CLK}$ to operate the shift register 90. The output signals from the shift register 90 are latched by the latch circuit 91. When a timing signal is inputted into the terminal $\Phi_T$, the driving signal is outputted from the AND circuit 92 in accordance with the recording signal. When the driving signal is inputted into the gate electrode, the channel regions of the MOS transistor are entirely depleted over and the inversion layer is formed, thus enabling high-speed switching operations by the thin film MOS transistor.

In this example, only the MOS transistor was formed within the single-crystal semiconductor layer. However, in an alternative, it is possible to form each of the shift register 90, the latch circuit 91 and the AND circuit within an independent single-crystal semiconductor layer. In this case, a further reduction in the production cost can be attained.

As above described, according to the present invention, a desirable recording head with integrally housed semiconductor functional elements can be efficiently manufactured at a reduced production cost.

What we claim is:

1. A method for manufacturing a recording head with a plurality of functional elements housed integrally therein, said method comprising the steps of:

(a) providing a plurality of base members each having a single-crystal semiconductor layer disposed thereon, and a common substrate having a surface with an area which is greater than a sum of the surface areas of said plurality of base members, (b) bonding said single-crystal semiconductor layers of said plurality of base members to the surface of said common substrate in a face-to-face state, (c) removing said plurality of base members such that said single-crystal semiconductor layers remain on said common substrate, (d) forming said plurality of functional elements on said common substrate using said single-crystal semiconductor layers, and (e) forming a plurality of electrothermal transducers on said common substrate, each electrothermal transducer for generating thermal energy.

2. The method according to claim 1, wherein each single-crystal semiconductor layer contains silicon atoms.

3. The method according to claim 1, wherein each functional element is selected from a group consisting of diode, transistor and thyrister.

4. The method according to claim 1, wherein each base member comprises a single-crystal silicon member or a polycrystal silicon member.

5. The method according to claim 1, wherein each electrothermal transducer is formed on an insulating layer obtained by oxidizing the single-crystal semiconductor layer.

6. The method according to claim 1, wherein a member for forming an ink discharging outlet and a liquid chamber is affixed to a side of the common substrate where the electrothermal transducers are disposed.

7. The method according to claim 6 further comprising the step of forming a liquid feed means for supplying ink into the liquid chamber.

* * * * *

UNITED STATES PATENT AND TRADEMARK OFFICE

CERTIFICATE OF CORRECTION

PATENT NO. : 5,322,811

DATED : June 21, 1994

INVENTOR(S) : HIROKAZU KOMURO, ET AL.

It is certified that error appears in the above-identified patent and that said Letters Patent is hereby corrected as shown below:

COLUMN 1

Line 39, "potion" should read --portion--.

COLUMN 4

Line 1, "provide" should read --provided--.
Line 4, "grown" should read --grown on--.
Line 61, "reference 200" should read --reference 210-- and "of the" should be deleted.

COLUMN 5

Line 36, "be" should read --may be--.

COLUMN 7

Line 14, "same" should read --same as--.
Line 16, "a ink" should read --an ink--.
Line 17, "of a" should read --of an--.

COLUMN 8

Line 58, "are" should read --are caused--.

COLUMN 9

Line 11, "an" should read --a--.
Line 21, "later 3" should read --layer 3--.

UNITED STATES PATENT AND TRADEMARK OFFICE

CERTIFICATE OF CORRECTION

PATENT NO. : 5,322,811

DATED : June 21, 1994

INVENTOR(S) : HIROKAZU KOMURO, ET AL.

It is certified that error appears in the above-identified patent and that said Letters Patent is hereby corrected as shown below:

COLUMN 10

Line 20, "sigle-crystal" should read --single-crystal--.

COLUMN 11

Line 60, "of" should be deleted.

COLUMN 12

Line 68, "other" should read --another--.

COLUMN 13

Line 53, "of" should be deleted.

COLUMN 15

Line 29, "stacked" should read --stacked on--.
Line 34, "13(b)." should read --13(b)).--.
Line 61, "$Si_3N_4$" should read --Si--.

COLUMN 16

Line 39, "FIG. 6(a))" should read --FIG. 6(a)).--.
Line 47, "FIG. 6(b))" should read --FIG. 6(b)).--.

COLUMN 18

Line 38, "for" should read --for a--.
Line 43, "a" should read --an--.
Line 45, "a" should read --an--.

UNITED STATES PATENT AND TRADEMARK OFFICE

CERTIFICATE OF CORRECTION

PATENT NO. : 5,322,811

DATED : June 21, 1994

INVENTOR(S) : HIROKAZU KOMURO, ET AL.

It is certified that error appears in the above-identified patent and that said Letters Patent is hereby corrected as shown below:

COLUMN 20

Line 2, "for" should read --for a--.
Line 10, "Constitution" should read --constitution--.
Line 27, "over" should be deleted.
Line 67, "of" should read --of a--.

COLUMN 22

Line 2, "is" should read --are--.
Line 4, "claim 6" should read --claim 6,--.

Signed and Sealed this

Fifteenth Day of November, 1994

Bruce Lehman

*Attest:*

BRUCE LEHMAN

*Attesting Officer*

*Commissioner of Patents and Trademarks*